US010170131B2

(12) United States Patent
Koppens et al.

(10) Patent No.: US 10,170,131 B2
(45) Date of Patent: Jan. 1, 2019

(54) DECODING METHOD AND DECODER FOR DIALOG ENHANCEMENT

(71) Applicant: DOLBY INTERNATIONAL AB, Amsterdam (NL)

(72) Inventors: Jeroen Koppens, Sodertalje (SE); Per Ekstrand, Saltsjobaden (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/513,543

(22) PCT Filed: Sep. 30, 2015

(86) PCT No.: PCT/EP2015/072578

§ 371 (c)(1),
(2) Date: Mar. 22, 2017

(87) PCT Pub. No.: WO2016/050854

PCT Pub. Date: Apr. 7, 2016

(65) Prior Publication Data

US 2017/0309288 A1 Oct. 26, 2017

Related U.S. Application Data

(60) Provisional application No. 62/128,331, filed on Mar. 4, 2015, provisional application No. 62/059,015, filed on Oct. 2, 2014.

(51) Int. Cl.
*G10L 21/02* (2013.01)
*G10L 21/0316* (2013.01)
(Continued)

(52) U.S. Cl.
CPC ..... *G10L 21/0205* (2013.01); *G10L 21/0316* (2013.01); *H04S 3/008* (2013.01);
(Continued)

(58) Field of Classification Search
CPC ..... G10L 21/0205; G10L 21/0316; G10L 19/008; H04S 3/008; H04S 2400/01; H04S 2400/03; H04S 2420/03
See application file for complete search history.

(56) References Cited

U.S. PATENT DOCUMENTS 7,158,933 B2 1/2007 Balan
7,606,716 B2 10/2009 Kraemer
(Continued)

FOREIGN PATENT DOCUMENTS

TW 201325269 6/2013
WO 2007/004829 1/2007
(Continued)

OTHER PUBLICATIONS

ETSI TS 103 190 v1.1.1 "Digital Audio Compression (AC-4) Standard" Apr. 2014, pp. 1-295.
(Continued)

*Primary Examiner* — Jason R Kurr

(57) ABSTRACT

There is provided a method for enhancing dialog in a decoder of an audio system. The method comprises receiving a plurality of downmix signals being a downmix of a larger plurality of channels; receiving parameters for dialog enhancement being defined with respect to a subset of the plurality of channels that is downmixed into a subset of the plurality of downmix signals; upmixing the subset of downmix signals parametrically in order to reconstruct the subset of the plurality of channels with respect to which the parameters for dialog enhancement are defined; applying dialog enhancement to the subset of the plurality of channels with respect to which the parameters for dialog enhancement are defined using the parameters for dialog enhancement to provide at least one dialog enhanced signal; and subjecting
(Continued)

the at least one dialog enhanced signal to mixing to provide dialog enhanced versions of the subset of downmix signals.

20 Claims, 6 Drawing Sheets

(51) Int. Cl.
*H04S 3/00* (2006.01)
*G10L 19/008* (2013.01)

(52) U.S. Cl.
CPC ..... *G10L 19/008* (2013.01); *H04S 2400/01* (2013.01); *H04S 2400/03* (2013.01); *H04S 2420/03* (2013.01)

(56) References Cited

U.S. PATENT DOCUMENTS

| | | | | |
|---|---|---|---|---|
| 7,714,750 | B2 | 5/2010 | Chang | |
| 7,852,239 | B2 | 12/2010 | Kong | |
| 8,126,152 | B2 | 2/2012 | Taleb | |
| 8,170,882 | B2 | 5/2012 | Davis | |
| 8,184,834 | B2 | 5/2012 | Oh | |
| 8,204,742 | B2 | 6/2012 | Yang | |
| 8,213,641 | B2 * | 7/2012 | Faller | G10L 19/008 381/119 |
| 8,275,610 | B2 | 9/2012 | Faller | |
| 8,346,564 | B2 | 1/2013 | Hotho | |
| 8,494,667 | B2 | 7/2013 | Pang | |
| 8,494,840 | B2 | 7/2013 | Muesch | |
| 8,515,759 | B2 | 8/2013 | Engdegard | |
| 8,577,676 | B2 | 11/2013 | Muesch | |
| 8,615,394 | B1 | 12/2013 | Avendano | |
| 8,639,502 | B1 | 1/2014 | Boucheron | |
| 8,838,262 | B2 | 9/2014 | Mehta | |
| 9,451,378 | B2 * | 9/2016 | Park | H04S 3/008 |
| 2004/0252850 | A1 | 12/2004 | Turicchia | |
| 2005/0114119 | A1 | 5/2005 | Oh | |
| 2006/0271354 | A1 | 11/2006 | Sun et al. | |
| 2011/0119061 | A1 | 5/2011 | Brown | |
| 2012/0002818 | A1 | 1/2012 | Heiko | |
| 2012/0039477 | A1 | 2/2012 | Schijers | |
| 2014/0044288 | A1 | 2/2014 | Kato | |
| 2014/0169572 | A1 | 6/2014 | Tran | |
| 2017/0309288 | A1 * | 10/2017 | Koppens | G10L 21/0205 |

FOREIGN PATENT DOCUMENTS

| | | |
|---|---|---|
| WO | 2008/031611 | 3/2008 |
| WO | 2014/187986 | 11/2014 |
| WO | 2015/010996 | 1/2015 |

OTHER PUBLICATIONS

Fuchs, H. et al "Dialogue Enhancement Technology and Experiments" EBU Technical Review, 2012, pp. 1-11.

Heuberger, Albert "Fraunhofer Surround Codecs Surround Codec Background, Technology, and Performance" IIS, Integrated circuits, publication date: unavailable.

Hellmuth, O. et al "Proposal for Extension of SAOC Technology for Advanced Clean Audio Functionality" ISO/IEC JTC1/SC29/WG11 MPEG 2013, Apr. 2013, pp. 1-12.

Breebaart, J. et al "Spatial Audio Processing: MPEG Surround and Other Applications" Wiley, 224 pages, Dec. 2007.

* cited by examiner

DECODING METHOD AND DECODER FOR DIALOG ENHANCEMENT

TECHNICAL FIELD

The invention disclosed herein generally relates to audio coding. In particular, it relates to methods and devices for enhancing dialog in channel-based audio systems.

BACKGROUND

Dialog enhancement is about enhancing dialog in relation to other audio content. This may for example be applied to allow hearing-impaired persons to follow the dialog in a movie. For channel-based audio content, the dialog is typically present in several channels and is also mixed with other audio content. Therefore it is a non-trivial task to enhance the dialog.

There are several known methods for performing dialog enhancement in a decoder. According to some of these methods, the full channel content, i.e. the full channel configuration, is first decoded and then received dialog enhancement parameters are used to predict the dialog on basis of the full channel content. The predicted dialog is then used to enhance the dialog in relevant channels. However, such decoding methods rely on a decoder capable of decoding the full channel configuration.

However, low complexity decoders are typically not designed to decode the full channel configuration. Instead, a low complexity decoder may decode and output a lower number of channels which represent a downmixed version of the full channel configuration. Accordingly, the full channel configuration is not available in the low complexity decoder. As the dialog enhancement parameters are defined with respect to the channels of the full channel configuration (or at least with respect to some of the channels of the full channel configuration) the known dialog enhancement methods cannot be applied directly by a low complexity decoder. In particular, this is the case since channels with respect to which the dialog enhancement parameters apply may still be mixed with other channels.

There is thus room for improvements that allow a low complexity decoder to apply dialog enhancement without having to decode the full channel configuration.

BRIEF DESCRIPTION OF THE DRAWINGS

In what follows, example embodiments will be described in greater detail and with reference to the accompanying drawings, on which.

Figure 1A:
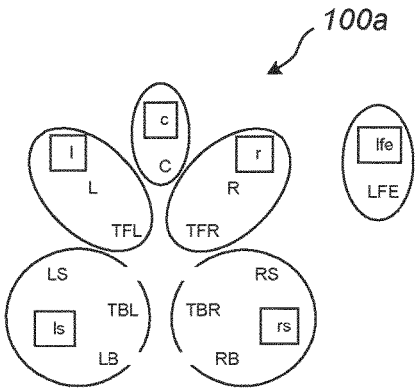
FIG. 1*a* is a schematic illustration of a 7.1+4 channel configuration which is downmixed into a 5.1 downmix according to a first downmixing scheme.

All the figures are schematic and generally only show such elements which are necessary in order to illustrate the invention, whereas other elements may be omitted or merely suggested.

DETAILED DESCRIPTION

In view of the above it is an object to provide a decoder and associated methods which allow application of dialog enhancement without having to decode the full channel configuration.

I. Overview

According to a first aspect, exemplary embodiments provide a method for enhancing dialog in a decoder of an audio system. The method comprises the steps of:

receiving a plurality of downmix signals being a downmix of a larger plurality of channels;

receiving parameters for dialog enhancement, wherein the parameters are defined with respect to a subset of the plurality of channels including channels comprising dialog, wherein the subset of the plurality of channels is downmixed into a subset of the plurality of downmix signals;

receiving reconstruction parameters allowing parametric reconstruction of channels that are downmixed into the subset of the plurality of downmix signals;

upmixing the subset of the plurality of downmix signals parametrically based on the reconstruction parameters in order to reconstruct the subset of the plurality of channels with respect to which the parameters for dialog enhancement are defined;

applying dialog enhancement to the subset of the plurality of channels with respect to which the parameters for dialog enhancement are defined using the parameters for dialog enhancement so as to provide at least one dialog enhanced signal; and subjecting the at least one dialog enhanced signal to mixing so as to provide dialog enhanced versions of the subset of the plurality of downmix signals.

With this arrangement the decoder does not have to reconstruct the full channel configuration in order to perform dialog enhancement, thereby reducing complexity. Instead, the decoder reconstructs those channels that are required for the application of dialog enhancement. This includes, in particular, a subset of the plurality of channels with respect to which the received parameters for dialog enhancement are defined. Once the dialog enhancement has been carried out, i.e. when at least one dialog enhanced signal has been determined on basis of the parameters for dialog enhancement and the subset of the plurality of channels with respect to which these parameters are defined, dialog enhanced versions of the received downmix signals are determined by subjecting the dialog enhanced signal(s) to a mixing procedure. As a result, dialog enhanced versions of the downmix signals are produced for subsequent playback by the audio system.

In exemplary embodiments, an upmix operation may be complete (reconstructing the full set of encoded channels) or partial (reconstructing a subset of the channels).

As used herein, a downmix signal refers to a signal which is a combination of one or more signals/channels.

As used herein, upmixing parametrically refers to reconstruction of one or more signals/channels from a downmix signal by means of parametric techniques. It is emphasized that the exemplary embodiments disclosed herein are not restricted to channel-based content (in the sense of audio signals associated with invariable or predefined directions, angles and/or positions in space) but also extends to object-based content.

According to exemplary embodiments, in the step of upmixing the subset of the plurality of downmix signals parametrically, no decorrelated signals are used in order to reconstruct the subset of the plurality of channels with respect to which the parameters for dialog enhancement are defined.

This is advantageous in that it reduces computational complexity at the same time as it improves quality of the resulting dialog enhanced versions of the downmix signals (i.e. the quality at the output). In more detail, the advantages gained by using decorrelated signals when upmixing are reduced by the subsequent mixing to which the dialog enhanced signal is subject. Therefore, the use of decorrelated signals may advantageously be omitted, thereby saving computation complexity. In fact, the use of decorrelated signals in the upmix could in combination with the dialog enhancement result in a worse quality since it could result in a decorrelator reverb on the enhanced dialog.

According to exemplary embodiments, the mixing is made in accordance with mixing parameters describing a contribution of the at least one dialog enhanced signal to the dialog enhanced versions of the subset of the plurality of downmix signals. There may thus be some mixing parameters which describe how to mix the at least one dialog enhanced signal in order to provide dialog enhanced versions of the subset of the plurality of downmix signals. For example, the mixing parameters may be in the form of weights which describe how much of the at least one dialog enhanced signal should be mixed into each of the downmix signals in the subset of the plurality of downmix signals to obtain the dialog enhanced versions of the subset of the plurality of downmix signals. Such weights may for example be in the form of rendering parameters which are indicative of spatial positions associated with the at least one dialog enhanced signal in relation to spatial positions associated with the plurality of channels, and therefore the corresponding subset of downmix signals. According to other examples, the mixing parameters may indicate whether or not the at least one dialog enhanced signal should contribute to, such as being included in, a particular one of the dialog enhanced version of the subset of downmix signals. For example, a "1" may indicate that a dialog enhanced signal should be included when forming a particular one of the dialog enhanced version of the downmix signals, and a "0" may indicate that it should not be included.

In the step of subjecting the at least one dialog enhanced signal to mixing so as to provide dialog enhanced versions of the subset of the plurality of downmix signals, the dialog enhanced signals may be mixed with other signals/channels.

According to exemplary embodiments, the at least one dialog enhanced signal is mixed with channels that are reconstructed in the upmixing step, but which have not been subject to dialog enhancement. In more detail, the step of upmixing the subset of the plurality of downmix signals parametrically may comprise reconstructing at least one further channel besides the plurality of channels with respect to which the parameters for dialog enhancement are defined, and wherein the mixing comprises mixing the at least one further channel together with the at least one dialog enhanced signal. For example, all channels that are downmixed into the subset of the plurality of downmix signals may be reconstructed and included in the mixing. In such embodiments, there is typically a direct correspondence between each dialog enhanced signal and a channel.

According to other exemplary embodiments, the at least one dialog enhanced signal is mixed with the subset of the plurality of downmix signals. In more detail, the step of upmixing the subset of the plurality of downmix signals parametrically may comprise reconstructing only the subset of the plurality of channels with respect to which the parameters for dialog enhancement are defined, and the step of applying dialog enhancement may comprise predicting and enhancing a dialog component from the subset of the plurality of channels with respect to which the parameters for dialog enhancement are defined using the parameters for dialog enhancement so as to provide the at least one dialog enhanced signal, and the mixing may comprise mixing the at least one dialog enhanced signal with the subset of the plurality of downmix signals. Such embodiments thus serve to predict and enhance the dialog content and mix it into the subset of the plurality of downmix signals.

Generally it is to be noted that a channel may comprise dialog content which is mixed with non-dialog content. Further, dialog content corresponding to one dialog may be mixed into several channels. By predicting a dialog component from the subset of the plurality of channels with respect to which the parameters for dialog enhancement are defined is generally meant that the dialog content is extracted, i.e. separated, from the channels and combined in order to reconstruct the dialog.

The quality of the dialog enhancement may further be improved by receiving and using an audio signal representing dialog. For example, the audio signal representing dialog may be coded at a low bitrate causing well audible artefacts when listened to separately. However, when used together with the parametrical dialog enhancement, i.e. the step of applying dialog enhancement to the subset of the plurality of channels with respect to which the parameters for dialog enhancement are defined using the parameters for dialog enhancement, the resulting dialog enhancement may be improved, e.g. in terms of audio quality. More particularly, the method may further comprise: receiving an audio signal representing dialog, wherein the step of applying dialog enhancement comprises applying dialog enhancement to the subset of the plurality of channels with respect to which the parameters for dialog enhancement are defined further using the audio signal representing dialog.

In some embodiments the mixing parameters may already be available in the decoder, e.g. they may be hardcoded. This would in particular be the case if the at least one dialog enhanced signal is always mixed in the same way, e.g. if it is always mixed with the same reconstructed channels. In other embodiments the method comprises receiving mixing parameters for the step of subjecting the at least one dialog enhanced signal to mixing. For example, the mixing parameters may form part of the dialog enhancement parameters.

According to exemplary embodiments, the method comprises receiving mixing parameters describing a downmixing scheme describing into which downmix signal each of the plurality of channels is mixed. For example, if each dialog enhanced signal corresponds to a channel, which in turn is mixed with other reconstructed channels, the mixing is carried out in accordance with the downmixing scheme so that each channel is mixed into the correct downmix signal.

The downmixing scheme may vary with time, i.e. it may be dynamic, thereby increasing the flexibility of the system.

The method may further comprise receiving data identifying the subset of the plurality of channels with respect to which the parameters for dialog enhancement are defined. For example, the data identifying the subset of the plurality of channels with respect to which the parameters for dialog enhancement are defined may be included in the parameters for dialog enhancement. In this way it may be signaled to the decoder with respect to which channels the dialog enhancement should be carried out. Alternatively, such information may be available in the decoder, e.g. being hard coded, meaning that the parameters for dialog enhancement are always defined with respect to the same channels. In particular, the method may further include receiving information indicating which signals of the dialog-enhanced signals that are to be subjected to mixing. For instance, the method according to this variation may be carried out by a decoding system operating in a particular mode, wherein the dialog-enhanced signals are not mixed back into a fully identical set of downmix signals as was used for providing the dialog-enhanced signals. In this fashion, the mixing operation may in practice be restricted to a non-complete selection (one or more signal) of the subset of the plurality of downmix signals. The other dialog-enhanced signals are added to slightly different downmix signals, such as downmix signals having undergone a format conversion. Once the data identifying the subset of the plurality of channels with respect to which the parameters for dialog enhancement are defined and the downmixing scheme are known, it is possible to find the subset of the plurality of downmix signals into which the subset of the plurality of channels with respect to which the parameters for dialog enhancement are defined is downmixed. In more detail, the data identifying the subset of the plurality of channels with respect to which the parameters for dialog enhancement are defined together with the downmixing scheme may be used to find the subset of the plurality of downmix signals into which the subset of the plurality of channels with respect to which the parameters for dialog enhancement are defined is downmixed.

The steps of upmixing the subset of the plurality of downmix signals, applying dialog enhancement, and mixing may be performed as matrix operations defined by the reconstruction parameters, the parameters for dialog enhancement, and the mixing parameters, respectively. This is advantageous in that the method may be implemented in an efficient way by performing matrix multiplication.

Moreover, the method may comprise combining, by matrix multiplication, the matrix operations corresponding to the steps of upmixing the subset of the plurality of downmix signals, applying dialog enhancement, and mixing, into a single matrix operation before application to the subset of the plurality of downmix signals. Thus, the different matrix operations may be combined into a single matrix operation, thus further improving the efficiency and reducing computational complexity of the method.

The dialog enhancement parameters and/or the reconstruction parameters may be frequency dependent, thus allowing the parameters to differ between different frequency bands. In this way, the dialog enhancement and the reconstruction may be optimized in the different frequency bands, thereby improving the quality of the output audio.

In more detail, the parameters for dialog enhancement may be defined with respect to a first set of frequency bands and the reconstruction parameters may be defined with respect to a second set of frequency bands, the second set of frequency bands being different than the first set of frequency bands. This may be advantageous in reducing the bitrate for transmitting the parameters for dialog enhancement and the reconstruction parameters in a bitstream when e.g. the process of reconstruction requires parameters at a higher frequency resolution than the process of dialog enhancement, and/or when e.g. the process of dialog enhancement is performed on a smaller bandwidth than the process of reconstruction.

According to exemplary embodiments, the (preferably discrete) values of the parameters for dialog enhancement may be received repeatedly and associated with a first set of time instants, at which respective values apply exactly. In the present disclosure, a statement to the effect that a value applies, or is known, "exactly" at a certain time instant is intended to mean that the value has been received by the decoder, typically along with an explicit or implicit indication of a time instant where it applies. In contrast, a value that is interpolated or predicted for a certain time instant does not apply "exactly" at the time instant in this sense, but is a decoder-side estimate. "Exactly" does not imply that the value achieves exact reconstruction of an audio signal. Between consecutive time instants in the set, a predefined first interpolation pattern may be prescribed. An interpolation pattern, defining how to estimate an approximate value of a parameter at a time instant located between two bounding time instants in the set at which values of the parameter are known, can be for example linear or piecewise constant interpolation. If the prediction time instant is located a certain distance away from one of the bounding time instants, a linear interpolation pattern is based on the assumption that the value of the parameter at the prediction time instant depends linearly on said distance, while a piecewise constant interpolation pattern ensures that the value of the parameter does not change between each known value and the next. There may also be other possible interpolation patterns, including for example patterns that uses polynomials of degrees higher than one, splines, rational functions, Gaussian processes, trigonometric polynomials, wavelets, or a combination thereof, to estimate the value of the parameter at a given prediction time instant. The set of time instants may not be explicitly transmitted or stated but instead be inferred from the interpolation pattern, e.g. the start-point or end-point of a linear interpolation interval, which may be implicitly fixed to the frame boundaries of an audio processing algorithm. The reconstruction parameters may be received in a similar way: the (preferably discrete) values of the reconstruction parameters may be associated with a second set of time instants, and a second interpolation pattern may be performed between consecutive time instants.

The method may further include selecting a parameter type, the type being either parameters for dialog enhancement or reconstruction parameters, in such manner that the set of time instants associated with the selected type includes at least one prediction instant being a time instant that is absent from the set associated with the not-selected type. For example, if the set of time instants that the reconstruction parameters are associated with includes a certain time instant that is absent from the set of time instants that the parameters for dialog enhancement are associated with, the certain time instant will be a prediction instant if the selected type of parameters is the reconstruction parameters and the not-selected type of parameters is the parameters for dialog enhancement. In a similar way, in another situation, the prediction instant may instead be found in the set of time instants that the parameters for dialog enhancement are associated with, and the selected and not-selected types will be switched. Preferably, the selected parameter type is the type having the highest density of time instants with associated parameter values; in a given use case, this may reduce the total amount of necessary prediction operations.

The value of the parameters of the not-selected type, at the prediction instant, may be predicted. The prediction may be performed using a suitable prediction method, such as interpolation or extrapolation, and in view of the predefined interpolation pattern for the parameter types.

The method may include the step of computing, based on at least the predicted value of the parameters of the not-selected type and a received value of the parameters of the selected type, a joint processing operation representing at least upmixing of the subset of the downmix signals followed by dialog enhancement at the prediction instant. In addition to values of the reconstruction parameters and the parameters for dialog enhancement, the computation may be based on other values, such as parameter values for mixing, and the joint processing operation may represent also a step of mixing a dialog enhanced signal back into a downmix signal.

The method may include the step of computing, based on at least a (received or predicted) value of the parameters of the selected type and at least a (received or predicted) value of the parameters of the not-selected type, such that at least either of the values is a received value, the joint processing operation at an adjacent time instant in the set associated with the selected or the not-selected type. The adjacent time instant may be either earlier or later than the prediction instant, and it is not essential to require that the adjacent time instant be the closest neighbor in terms of distance.

In the method, the steps of upmixing the subset of the plurality of downmix signals and applying dialog enhancement may be performed between the prediction instant and the adjacent time instant by way of an interpolated value of the computed joint processing operation. By interpolating the computed joint processing operation, a reduced computational complexity may be achieved. By not interpolating both parameter types separately, and by not forming a product (i.e. a joint processing operation), at each interpolation point, fewer mathematical addition and multiplication operations may be required to achieve an equally useful result in terms of perceived listening quality.

According to further exemplary embodiments, the joint processing operation at the adjacent time instant may be computed based on a received value of the parameters of the selected type and a predicted value of the parameters of the not-selected type. The reverse situation is also possible, where the joint processing operation at the adjacent time instant may be computed based on a predicted value of the parameters of the selected type and a received value of the parameters of the not-selected type. Situations where a value of the same parameter type is a received value at the prediction instant and a predicted value at the adjacent time instant may occur if, for example, the time instants in the set with which the selected parameter type is associated are located strictly in between the time instants in the set with which the not-selected parameter type is associated.

According to exemplary embodiments, the joint processing operation at the adjacent time instant may be computed based on a received value of the parameters of the selected parameter type and a received value of the parameters of the not-selected parameter type. Such situations may occur, e.g., if exact values of parameters of both types are received for frame boundaries, but also—for the selected type—for a time instant midway between boundaries. Then the adjacent time instant is a time instant associated with a frame boundary, and the prediction time instant is located midway between frame boundaries.

According to further exemplary embodiments, the method may further include selecting, on the basis of the first and second interpolation patterns, a joint interpolation pattern according to a predefined selection rule, wherein the interpolation of the computed respective joint processing operations is in accordance with the joint interpolation pattern. The predefined selection rule may be defined for the case where the first and second interpolation patterns are equal, and it may also be defined for the case where the first and second interpolation patterns are different. As an example, if the first interpolation pattern is linear (and preferably, if there is a linear relationship between parameters and quantitative properties of the dialog enhancement operation) and the second interpolation pattern is piecewise constant, the joint interpolation pattern may be selected to be linear.

According to exemplary embodiments, the prediction of the value of the parameters of the not-selected type at the prediction instant is made in accordance with the interpolation pattern for the parameters of the not-selected type. This may involve using an exact value of the parameter of the not-selected type, at a time instant in the set associated with the not-selected type that is adjacent to the prediction instant.

According to exemplary embodiments, the joint processing operation is computed as a single matrix operation and then applied to the subset of the plurality of downmix signals. Preferably, the steps of upmixing and applying dialog enhancement are performed as matrix operations defined by the reconstruction parameters and parameters for dialog enhancement. As a joint interpolation pattern, a linear interpolation pattern may be selected, and the interpolated value of the computed respective joint processing operations may be computed by linear matrix interpolation. Interpolation may be restricted to such matrix elements that change between the prediction instant and the adjacent time instant, in order to reduce computational complexity.

According to exemplary embodiments, the received downmix signals may be segmented into time frames, and the method may include, in steady state operation, a step of receiving at least one value of the respective parameter types that applies exactly at a time instant in each time frame. As used herein "steady-state" refers to operation not involving the presence of initial and final portions of e.g. a song, and operation not involving internal transients necessitating frame sub-division.

According to a second aspect, there is provided a computer program product comprising a computer-readable medium with instructions for performing the method of the first aspect. The computer-readable medium may be a non-transitory computer-readable medium or device.

According to a third aspect, there is provided a decoder for enhancing dialog in an audio system, the decoder comprising:

a receiving component configured to receive:

a plurality of downmix signals being a downmix of a larger plurality of channels, parameters for dialog enhancement, wherein the parameters are defined with respect to a subset of the plurality of channels including channels comprising dialog, wherein the subset of the plurality of channels is downmixed into a subset of the plurality of downmix signals, and reconstruction parameters allowing parametric reconstruction of channels that are downmixed into the subset of the plurality of downmix signals;

an upmixing component configured to upmix the subset of the plurality of downmix signals parametrically based on the reconstruction parameters in order to reconstruct the subset of the plurality of channels with respect to which the parameters for dialog enhancement are defined; and a dialog enhancement component configured to apply dialog enhancement to the subset of the plurality of channels with respect to which the parameters for dialog enhancement are defined using the parameters for dialog enhancement so as to provide at least one dialog enhanced signal; and a mixing component configured to subject the at least one dialog enhanced signal to mixing so as to provide dialog enhanced versions of the subset of the plurality of downmix signals.

Generally, the second and the third aspect may comprise the same features and advantages as the first aspect.

II. Example Embodiments

Figure 1B:
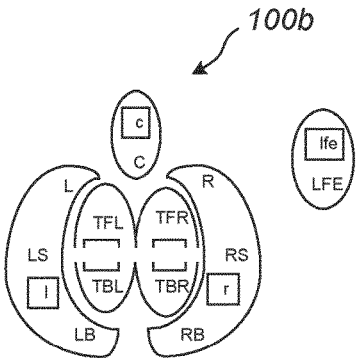
FIG. 1*b* is a schematic illustration of a 7.1+4 channel configuration which is downmixed into a 5.1 downmix according to a second downmixing scheme.

FIG. 1*a* and FIG. 1*b* schematically illustrate a 7.1+4 channel configuration (corresponding to a 7.1+4 speaker configuration) with three front channels L, C, R, two surround channels LS, RS, two back channels LB, RB, four elevated channels TFL, TFR, TBL, TBR, and a low frequency effects channel LFE. In the process of encoding the 7.1+4 channel configuration, the channels are typically downmixed, i.e. combined into a lower number of signals, referred to as downmix signals. In the downmixing process, the channels may be combined in different ways to form different downmix configurations. FIG. 1*a* illustrates a first 5.1 downmix configuration 100*a* with downmix signals l, c, r, ls, rs, lfe. The circles in the figure indicate which channels are downmixed into which downmix signals. FIG. 1*b* illustrates a second 5.1 downmix configuration 100*b* with downmix signals l, c, r, tl, tr, lfe. The second 5.1 downmix configuration 100*b* is different from the first 5.1 downmix configuration 100*a* in that the channels are combined in a different way. For example, in the first downmix configuration 100*a*, the L and TFL channels are downmixed into the l downmix signal, whereas in the second downmix configuration 100*b* the L, LS, LB channels are downmixed into the l downmix signal. The downmix configuration is sometimes referred to herein as a downmixing scheme describing which channels are downmixed into which downmix signals. The downmixing configuration, or downmixing scheme, may be dynamic in that it may vary between time frames of an audio coding system. For example, the first downmixing scheme 100*a* may be used in some time frames whereas the second downmixing scheme 100*b* may be used in other time frames. In case the downmixing scheme varies dynamically, the encoder may send data to the decoder indicating which downmixing scheme was used when encoding the channels.

Figure 2:
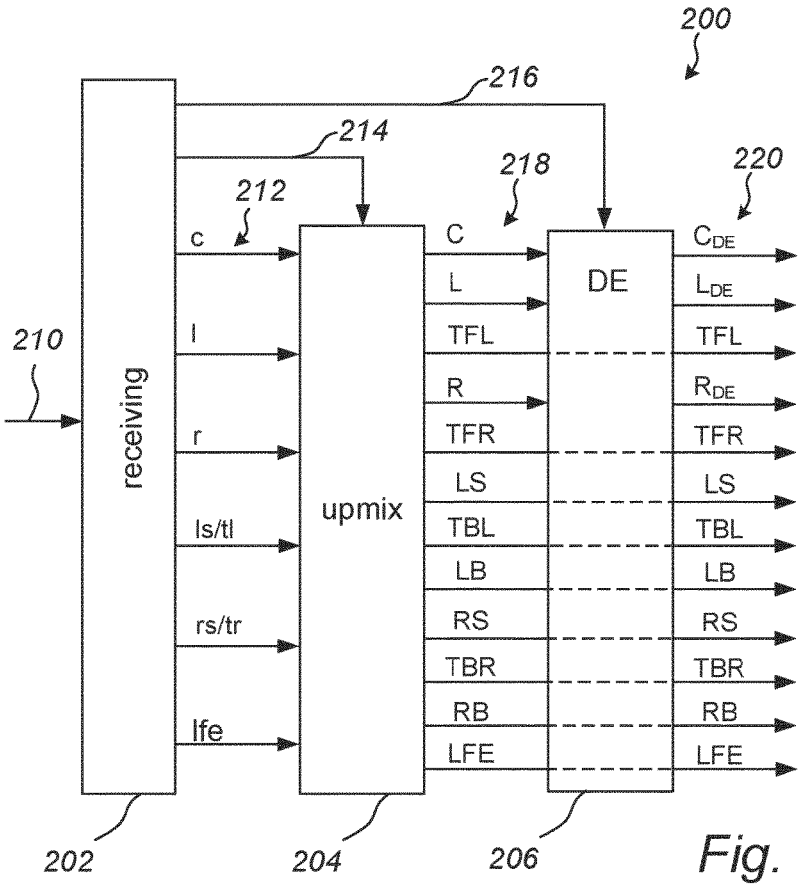
FIG. 2 is a schematic illustration of a prior art decoder for performing dialog enhancement on a fully decoded channel configuration.

FIG. 2 illustrates a prior art decoder 200 for dialog enhancement. The decoder comprises three principal components, a receiving component 202, an upmix, or reconstruction, component 204, and a dialog enhancement (DE) component 206. The decoder 200 is of the type that receives a plurality of downmix signals 212, reconstructs the full channel configuration 218 on basis of the received downmix signals 212, performs dialog enhancement with respect to the full channel configuration 218, or at least a subset of it, and outputs a full configuration of dialog enhanced channels 220.

In more detail, the receiving component 202 is configured to receive a data stream 210 (sometimes referred to as a bit stream) from an encoder. The data stream 210 may comprise different types of data, and the receiving component 202 may decode the received data stream 210 into the different types of data. In this case the data stream comprises a plurality of downmix signals 212, reconstruction parameters 214, and parameters for dialog enhancement 216.

The upmix component 204 then reconstructs the full channel configuration on basis of the plurality of downmix signals 212 and the reconstruction parameters 214. In other words, the upmix component 204 reconstructs all channels 218 that were downmixed into the downmix signals 212. For example, the upmix component 204 may reconstruct the full channel configuration parametrically on basis of the reconstruction parameters 214.

In the illustrated example, the downmix signals 212 correspond to the downmix signals of one of the 5.1 downmix configurations of FIGS. 1*a* and 1*b*, and the channels 218 corresponds to the channels of the 7.1+4 channel configuration of FIGS. 1*a* and 1*b*. However, the principles of the decoder 200 would of course apply to other channel configurations/downmix configurations.

The reconstructed channels 218, or at least a subset of the reconstructed channels 218, are then subject to dialog enhancement by the dialog enhancement component 206. For example, the dialog enhancement component 206 may perform a matrix operation on the reconstructed channels 218, or at least a subset of the reconstructed channels 218, in order to output dialog enhanced channels. Such a matrix operation is typically defined by the dialog enhancement parameters 216.

By way of example, the dialog enhancement component 206 may subject the channels C, L, R to dialog enhancement in order to provide dialog enhanced channels $C_{DE}$, $L_{DE}$, $R_{DE}$, whereas the other channels are just passed through as indicated by the dashed lines in FIG. 2. In such a situation, the dialog enhancement parameters are just defined with respect to the C, L, R channels, i.e. with respect to a subset of the plurality of channels 218. For instance, the dialog enhancement parameters 216 may define a 3×3 matrix which may be applied to the C, L, R channels.

$$\begin{bmatrix} C_{DE} \\ L_{DE} \\ R_{DE} \end{bmatrix} = \begin{bmatrix} m_{11} & m_{12} & m_{13} \\ m_{21} & m_{22} & m_{23} \\ m_{31} & m_{32} & m_{33} \end{bmatrix} \cdot \begin{bmatrix} C \\ L \\ R \end{bmatrix}$$

Alternatively the channels not involved in dialog enhancement may be passed through by means of the dialog enhancement matrix with 1 on the corresponding diagonal positions and 0 on all other elements in the corresponding rows and columns.

$$\begin{bmatrix} C_{DE} \\ L_{DE} \\ TFL \\ R_{DE} \\ TFR \\ LS \\ TBL \\ LB \\ RS \\ TBR \\ RB \\ LFE \end{bmatrix} = \begin{bmatrix} m_{11} & m_{12} & 0 & m_{13} & 0 & 0 & 0 & 0 & 0 & 0 & 0 & 0 \\ m_{21} & m_{22} & 0 & m_{23} & 0 & 0 & 0 & 0 & 0 & 0 & 0 & 0 \\ 0 & 0 & 1 & 0 & 0 & 0 & 0 & 0 & 0 & 0 & 0 & 0 \\ m_{31} & m_{32} & 0 & m_{33} & 0 & 0 & 0 & 0 & 0 & 0 & 0 & 0 \\ 0 & 0 & 0 & 0 & 1 & 0 & 0 & 0 & 0 & 0 & 0 & 0 \\ 0 & 0 & 0 & 0 & 0 & 1 & 0 & 0 & 0 & 0 & 0 & 0 \\ 0 & 0 & 0 & 0 & 0 & 0 & 1 & 0 & 0 & 0 & 0 & 0 \\ 0 & 0 & 0 & 0 & 0 & 0 & 0 & 1 & 0 & 0 & 0 & 0 \\ 0 & 0 & 0 & 0 & 0 & 0 & 0 & 0 & 1 & 0 & 0 & 0 \\ 0 & 0 & 0 & 0 & 0 & 0 & 0 & 0 & 0 & 1 & 0 & 0 \\ 0 & 0 & 0 & 0 & 0 & 0 & 0 & 0 & 0 & 0 & 1 & 0 \\ 0 & 0 & 0 & 0 & 0 & 0 & 0 & 0 & 0 & 0 & 0 & 1 \end{bmatrix} \cdot \begin{bmatrix} C \\ L \\ TFL \\ R \\ TFR \\ LS \\ TBL \\ LB \\ RS \\ TBR \\ RB \\ LFE \end{bmatrix}$$

Figure 3:
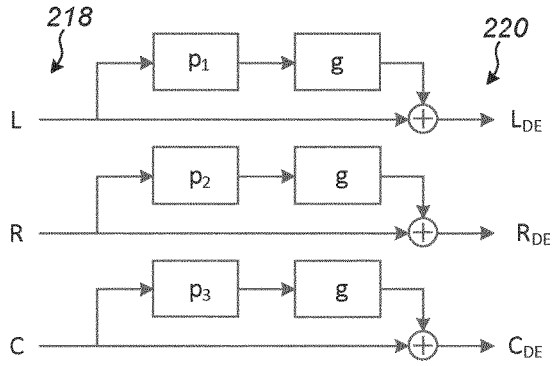
FIG. 3 is a schematic illustration of dialog enhancement according to a first mode.

The dialog enhancement component 206 may carry out dialog enhancement according to different modes. A first mode, referred to herein as channel independent parametric enhancement, is illustrated in FIG. 3. The dialog enhancement is carried out with respect to at least a subset of the reconstructed channels 218, typically the channels comprising dialog, here the channels L, R, C. The parameters for dialog enhancement 216 comprise a parameter set for each of the channels to be enhanced. In the illustrated example, the parameter sets are given by parameters $p_1$, $p_2$, $p_3$ corresponding to channels L, R, C, respectively. In principle the parameters transmitted in this mode represent the relative contribution of the dialog to the mix energy, for a time-frequency tile in a channel. Further, there is a gain factor g involved in the dialog enhancement process. The gain factor g may be expressed as:

$$g = 10^{\frac{G}{20}} - 1$$

where G is a dialog enhancement gain expressed in dB. The dialog enhancement gain G may for example be input by a user, and is therefore typically not included in the data stream 210 of FIG. 2.

When in channel independent parametric enhancement mode, the dialog enhancement component 206 multiplies each channel by its corresponding parameter $p_i$ and the gain factor g, and then adds the result to the channel, so as to produce dialog enhanced channels 220, here $L_{DE}$, $R_{DE}$, $C_{DE}$. Using matrix notation, this may be written as:

$$X_e = (I + \mathrm{diag}(p) \cdot g) \cdot X$$

where X is a matrix having the channels 218 (L, R, C) as rows, $X_e$ is a matrix having the dialog enhanced channels 220 as rows, p is a row vector with entries corresponding to the dialog enhancement parameters $p_1$, $p_2$, $p_3$ for each channel, and diag(p) is a diagonal matrix having the entries of p on the diagonal.

Figure 4:
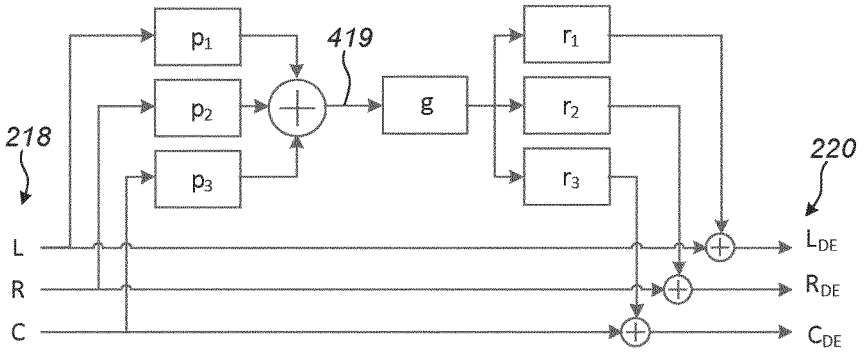
FIG. 4 is a schematic illustration of dialog enhancement according to a second mode.

A second dialog enhancement mode, referred to herein as multichannel dialog prediction, is illustrated in FIG. 4. In this mode the dialog enhancement component 206 combines multiple channels 218 in a linear combination to predict a dialog signal 419. Apart from coherent addition of the dialog's presence in multiple channels, this approach may benefit from subtracting background noise in a channel comprising dialog using another channel without dialog. For this purpose, the dialog enhancement parameters 216 comprise a parameter for each channel 218 defining the coefficient of the corresponding channel when forming the linear combination. In the illustrated example, the dialog enhancement parameters 216 comprises parameters $p_1$, $p_2$, $p_3$ corresponding to the L, R, C channels, respectively. Typically, minimum mean square error (MMSE) optimization algorithms may be used to generate the prediction parameters at the encoder side.

The dialog enhancement component 206 may then enhance, i.e. gain, the predicted dialog signal 419 by application of a gain factor g, and add the enhanced dialog signal to the channels 218, in order to produce the dialog enhanced channels 220. To add the enhanced dialog signal to the correct channels at the correct spatial position (otherwise it will not enhance the dialog with the expected gain) the panning between the three channels is transmitted by rendering coefficients, here $r_1$, $r_2$, $r_3$. Under the restriction that the rendering coefficients are energy preserving, i.e.

$$r_1^2 + r_2^2 + r_3^2 = 1$$

the third rendering coefficient $r_3$ may be determined from the first two coefficients such that $$r_3 = \sqrt{1 - r_1^2 - r_2^2}$$

Using matrix notation, the dialog enhancement carried out by the dialog enhancement 206 component when in multichannel dialog prediction mode may be written as:

$$X_e = (I + g \cdot H \cdot P) \cdot X$$

or $$X_e = \begin{bmatrix} 1 + g \cdot r_1 \cdot p_1 & g \cdot r_1 \cdot p_2 & g \cdot r_1 \cdot p_3 \\ g \cdot r_2 \cdot p_1 & 1 + g \cdot r_2 \cdot p_2 & g \cdot r_2 \cdot p_3 \\ g \cdot r_3 \cdot p_1 & g \cdot r_3 \cdot p_2 & 1 + g \cdot r_3 \cdot p_3 \end{bmatrix} \cdot X$$

where I is the identity matrix, X is a matrix having the channels 218 (L, R, C) as rows, $X_e$ is a matrix having the dialog enhanced channels 220 as rows, P is a row vector with entries corresponding to the dialog enhancement parameters $p_1$, $p_2$, $p_3$ for each channel, H is a column vector having the rendering coefficients $r_1$, $r_2$, $r_3$ as entries, and g is the gain factor with $$g = 10^{\frac{G}{20}} - 1.$$

According to a third mode, referred to herein as waveform-parametric hybrid, the dialog enhancement component 206 may combine either of the first and the second mode with transmission of an additional audio signal (a waveform signal) representing dialog. The latter is typically coded at a low bitrate causing well audible artefacts when listened to separately. Depending on the signal properties of the channels 218 and the dialog, and the bitrate assigned to the dialog waveform signal coding, the encoder also determines a blending parameter, $\alpha_c$, that indicates how the gain contributions should be divided between the parametric contribution (from the first or second mode) and the additional audio signal representing dialog.

In combination with the second mode, the dialog enhancement of the third mode may be written as:

$$X_e = H \cdot g_1 \cdot d_c + (I + H \cdot g_2 \cdot P) \cdot X$$

or

-continued $$X_e = \begin{bmatrix} 1+g_2\cdot r_1\cdot p_1 & g_2\cdot r_1\cdot p_2 & g_2\cdot r_1\cdot p_3 & g_1\cdot r_1 \\ g_2\cdot r_2\cdot p_1 & 1+g_2\cdot r_2\cdot p_2 & g_2\cdot r_2\cdot p_3 & g_1\cdot r_2 \\ g_2\cdot r_3\cdot p_1 & g_2\cdot r_3\cdot p_2 & 1+g_2\cdot r_3\cdot p_3 & g_1\cdot r_3 \end{bmatrix} \cdot \begin{bmatrix} X \\ d_c \end{bmatrix}$$

where $d_c$ is the additional audio signal representing dialog, with $$g_1 = \alpha_c \cdot \left(10^{\frac{G}{20}} - 1\right),$$

$$g_2 = (1-\alpha_c) \cdot \left(10^{\frac{G}{20}} - 1\right).$$

For the combination with channel independent enhancement (the first mode), an audio signal $d_{c,i}$ representing dialog is received for each channel 218. Writing $$D_c = \begin{pmatrix} d_{c,1} \\ d_{c,2} \\ d_{c,3} \end{pmatrix},$$

the dialog enhancement may be written as:

$$X_e = g_1 \cdot D_c + (I + \mathrm{diag}(p) \cdot g_2) \cdot X.$$

Figure 5:
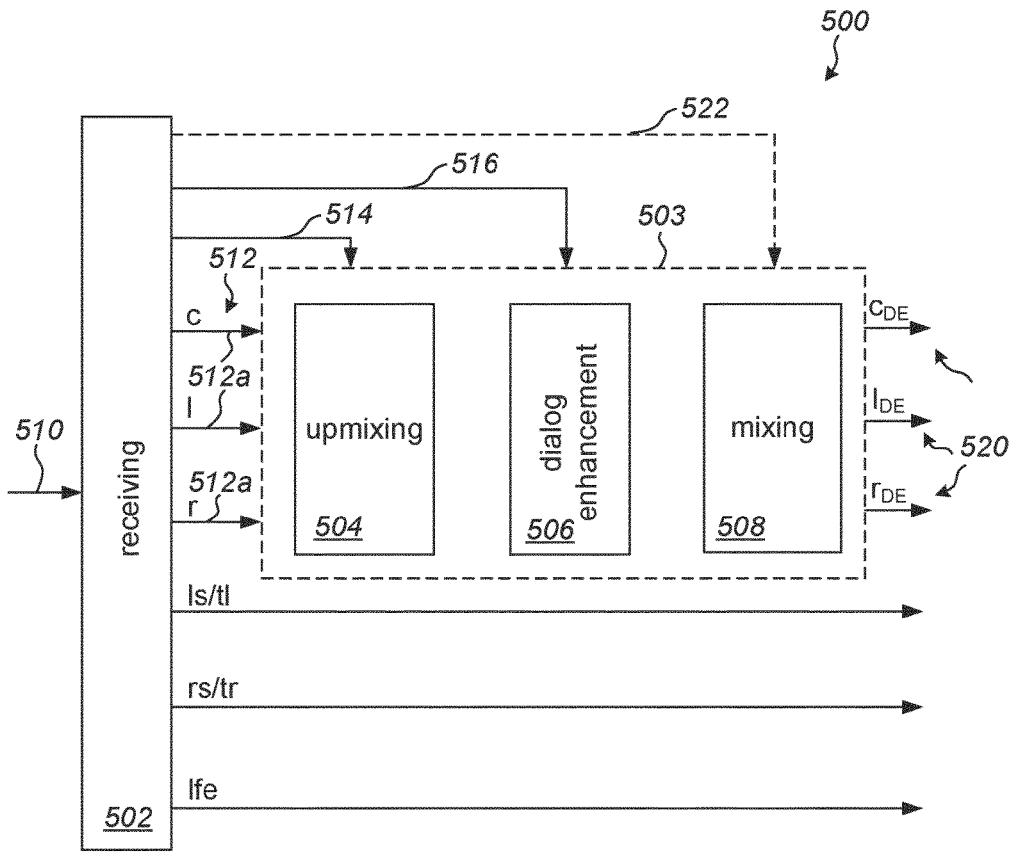
FIG. 5 is a schematic illustration of a decoder according to example embodiments.

FIG. 5 illustrates a decoder 500 according to example embodiments. The decoder 500 is of the type that decodes a plurality of downmix signals, being a downmix of a larger plurality of channels, for subsequent playback. In other words, the decoder 500 is different from the decoder of FIG. 2 in that it is not configured to reconstruct the full channel configuration.

The decoder 500 comprises a receiving component 502, and a dialog enhancement block 503 comprising an upmixing component 504, a dialog enhancement component 506, and a mixing component 508.

As explained with reference to FIG. 2, the receiving component 502 receives a data stream 510 and decodes it into its components, in this case a plurality of downmix signals 512 being a downmix of a larger plurality of channels (cf. FIGS. 1*a* and 1*b*), reconstruction parameters 514, and parameters for dialog enhancement 516. In some cases, the data stream 510 further comprises data indicative of mixing parameters 522. For example, the mixing parameters may form part of the parameters for dialog enhancement. In other cases, mixing parameters 522 are already available at the decoder 500, e.g. they may be hard coded in the decoder 500. In other cases, mixing parameters 522 are available for multiple sets of mixing parameters and data in the data stream 510 provides an indication to which set of these multiple sets of mixing parameters is used.

The parameters for dialog enhancement 516 are typically defined with respect to a subset of the plurality of channels. Data identifying the subset of the plurality of channels with respect to which the parameters for dialog enhancement are defined may be included in the received data stream 510, for instance as part of the parameters for dialog enhancement 516. Alternatively, the subset of the plurality of channels with respect to which the parameters for dialog enhancement are defined may be hard coded in the decoder 500. For example, referring to FIG. 1*a*, the parameters for dialog enhancement 516 may be defined with respect to channels L, TFL which are downmixed into the l downmix signal, the C channel which is comprised in the c downmix signal, and the R, TFR channels which are downmixed into the r downmix signal. For purposes of illustration, it is assumed that dialog is only present in the L, C, and R channels. It is to be noted that the parameters for dialog enhancement 516 may be defined with respect to channels comprising dialog, such as the L, C, R channels, but may also be defined with respect to channels which do no comprise dialog, such as the TFL, TFR channels in this example. In that way, background noise in a channel comprising dialog may for instance be subtracted using another channel without dialog.

The subset of channels with respect to which the parameters for dialog enhancement 516 is defined is downmixed into a subset 512*a* of the plurality of downmix signals 512. In the illustrated example, the subset 512*a* of downmix signals comprises the c, l, and r downmix signals. This subset of downmix signals 512*a* is input to the dialog enhancement block 503. The relevant subset 512*a* of downmix signals may e.g. be found on basis of knowledge of the subset of the plurality of channels with respect to which the parameters for dialog enhancement are defined and the downmixing scheme.

The upmixing component 514 uses parametric techniques as known in the art for reconstruction of channels that are downmixed into the subset of downmix signals 512*a*. The reconstruction is based on the reconstruction parameters 514. In particular, the upmixing component 504 reconstructs the subset of the plurality of channels with respect to which the parameters for dialog enhancement 516 are defined. In some embodiments, the upmixing component 504 reconstructs only the subset of the plurality of channels with respect to which the parameters for dialog enhancement 516 are defined. Such exemplary embodiments will be described with reference to FIG. 7. In other embodiments, the upmixing component 504 reconstructs at least one channel in addition to the subset of the plurality of channels with respect to which the parameters for dialog enhancement 516 are defined. Such exemplary embodiments will be described with reference to FIG. 6.

The reconstruction parameters may not only be time variable, but may also be frequency dependent. For example, the reconstruction parameters may take different values for different frequency bands. This will generally improve the quality of the reconstructed channels.

As is known in the art, parametric upmixing may generally include forming decorrelated signals from the input signals that are subject to the upmixing, and reconstruct signals parametrically on basis of the input signals and the decorrelated signals. See for example the book "Spatial Audio Processing: MPEG Surround and Other Applications" by Jeroen Breebaart and Christof Faller, ISBN: 978-9-470-03350-0. However, the upmixing component 504 preferably performs parametric upmixing without using any such decorrelated signals. The advantages gained by using decorrelated signals are in this case reduced by the subsequent downmixing performed in the mixing component 508. Therefore, the use of decorrelated signals may advantageously be omitted by the upmixing component 504, thereby saving computation complexity. In fact, the use of decorrelated signals in the upmix would in combination with the dialog enhancement result in a worse quality since it could result in a decorrelator reverb on the dialog.

The dialog enhancement component 506 then applies dialog enhancement to the subset of the plurality of channels with respect to which the parameters for dialog enhancement 516 are defined so as to produce at least one dialog enhanced signal. In some embodiments, the dialog enhanced signal corresponds to dialog enhanced versions of the subset of the plurality of channels with respect to which the parameters for dialog enhancement 516 are defined. This will be explained in more detail below with reference to FIG. 6. In other embodiments, the dialog enhanced signal corresponds to a predicted and enhanced dialog component of the subset of the plurality of channels with respect to which the parameters for dialog enhancement 516 are defined. This will be explained in more detail below with reference to FIG. 7.

Similar to the reconstruction parameters, the parameters for dialog enhancement may vary in time as well as with frequency. In more detail, the parameters for dialog enhancement may take different values for different frequency bands. The set of frequency bands with respect to which the reconstruction parameters are defined may differ from the set of frequency bands with respect to which the dialog enhancement parameters are defined.

The mixing component 508 then performs a mixing on basis of the at least one dialog enhanced signal so as to provide dialog enhanced versions 520 of the subset 512*a* of downmix signals. In the illustrated example, the dialog enhanced versions 520 of the subset 512*a* of downmix signals are given by $c_{DE}$, $l_{DE}$, $r_{DE}$ which corresponds to downmix signals c, l, r, respectively.

The mixing may be made in accordance with mixing parameters 522 describing a contribution of the at least one dialog enhanced signal to the dialog enhanced versions 520 of the subset of downmix signals 512*a*. In some embodiments, see FIG. 6, the at least one dialog enhanced signal is mixed together with channels that were reconstructed by the upmixing component 504. In such cases the mixing parameters 522 may correspond to a downmixing scheme, see FIGS. 1*a* and 1*b*, describing into which of the dialog enhanced downmix signals 520 each channel should be mixed. In other embodiments, see FIG. 7, the at least one dialog enhanced signals is mixed together with the subset 512*a* of downmix signals. In such case, the mixing parameters 522 may correspond to weighting factors describing how the at least one dialog enhanced signal should be weighted into the subset 512*a* of downmix signals.

The upmixing operation performed by the upmixing component 504, the dialog enhancement operation performed by the dialog enhancement component 506, and the mixing operation performed by the mixing component 508 are typically linear operations which each may be defined by a matrix operation, i.e. by a matrix-vector product. This is at least true if the decorrelator signals are omitted in the upmixing operation. In particular, the matrix associated with the upmixing operation (U) is defined by/may be derived from the reconstruction parameters 514. In this respect it is to be noted that the use of decorrelator signals in the upmixing operation is still possible but that the creation of the decorrelated signals is then not part of the matrix operation for upmixing. The upmixing operation with decorrelators may be seen as a two stage approach. In a first stage, the input downmix signals are fed to a pre-decorrelator matrix, and the output signals after application of the pre-decorrelator matrix are each fed to a decorrelator. In a second stage, the input downmix signals and the output signals from the decorrelators are fed into the upmix matrix, where the coefficients of the upmix matrix corresponding to the input downmix signals form what is referred to as the "dry upmix matrix" and the coeffiecients corresponding to the output signals from the decorrelators form what is referred to as "the wet upmix matrix". Each sub matrix maps to the upmix channel configuration. When the decorrelator signals are not used, the matrix associated with the upmixing operation is configured for operation on the input signals 512*a* only, and the columns related to decorrelated signals (the wet upmix matrix) are not included in the matrix. In other words, the upmix matrix in this case corresponds to the dry upmix matrix. However, as noted above, the use of decorrelator signals will in this case typically result in worse quality.

The matrix associated with the dialog enhancement operation (M) is defined by/may be derived from the parameters for dialog enhancement 516, and the matrix associated with the mixing operation (C) is defined by/may be derived from the mixing parameters 522.

Since the upmixing operation, the dialog enhancement operation, and the mixing operation are all linear operation, the corresponding matrices may be combined, by matrix multiplication, into a single matrix E (then $X_{DE}=E\cdot X$ with $E=C\cdot M\cdot U$). Here X is a column vector of the downmix signals 512*a*, and $X_{DE}$ is a column vector of the dialog enhanced downmix signals 520. Thus, the complete dialog enhancement block 503 may correspond to a single matrix operation which is applied to the subset 512*a* of downmix signals in order to produce the dialog enhanced versions 520 of the subset 512*a* of downmix signals. Accordingly, the methods described herein may be implemented in a very efficient way.

Figure 6:
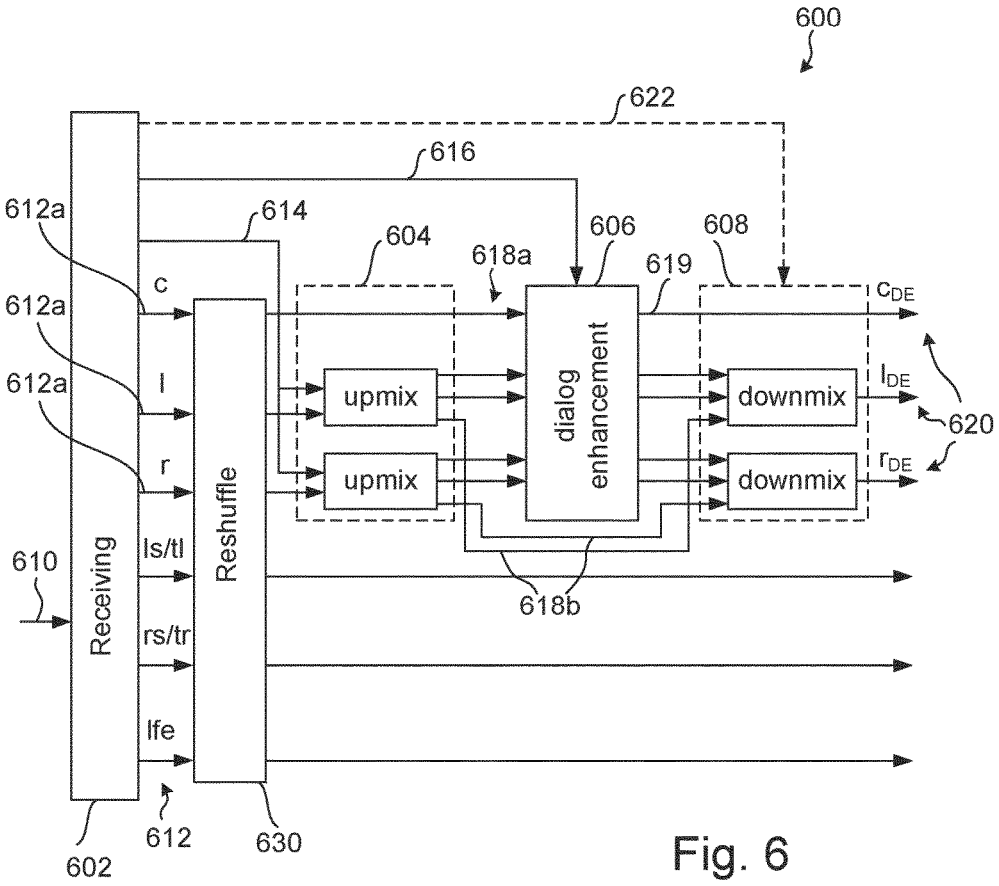
FIG. 6 is a schematic illustration of a decoder according to example embodiments.

FIG. 6 illustrates a decoder 600 which corresponds to an exemplary embodiment of the decoder 500 of FIG. 5. The decoder 600 comprises a receiving component 602, an upmixing component 604, a dialog enhancement component 606, and a mixing component 608.

Similar to the decoder 500 of FIG. 5, the receiving component 602 receives a data stream 610 and decodes it into a plurality of downmix signals 612, reconstruction parameters 614, and parameters for dialog enhancement 616.

The upmixing component 604 receives a subset 612*a* (corresponding to subset 512*a*) of the plurality of downmix signals 612. For each of the downmix signals in the subset 612*a*, the upmixing component 604 reconstructs all channels that were downmixed in the downmix signal ($X_u=U\cdot X$). This includes channels 618*a* with respect to which the parameters for dialog enhancement are defined, and channels 618*b* which are not to be involved in dialog enhancement. Referring to FIG. 1*b*, the channels 618*a* with respect to which the parameters for dialog enhancement are defined could for instance correspond to the L, LS, C, R, RS channels, and the channels 618*b* which are not to be involved in dialog enhancement may correspond to the LB, RB channels.

The channels 618*a* with respect to which the parameters for dialog enhancement are defined ($X'_u$) are then subject to dialog enhancement by the dialog enhancement component 606 ($X_e=M\cdot X'_u$), while the channels 618*b* which are not to be involved in dialog enhancement ($X''_u$) are bypassing the dialog enhancement component 606.

The dialog enhancement component 606 may apply any of the first, second, and third modes of dialog enhancement described above. In case the third mode is applied, the data stream 610 may as explained above comprise an audio signal representing dialog (i.e., a coded waveform representing dialog) to be applied in the dialog enhancement together with the subset 618*a* of the plurality of channels with respect to which the parameters for dialog enhancement are defined $$\left(X_e = M \cdot \begin{bmatrix} X'_u \\ D_c \end{bmatrix}\right).$$

As a result, the dialog enhancement component 606 outputs dialog enhanced signals 619, which in this case correspond to dialog enhanced versions of the subset 618*a* of channels with respect to which the parameters for dialog enhancement are defined. By way of example, the dialog enhanced signals 619 may correspond to dialog enhanced versions of the L, LS, C, R, RS channels of FIG. 1*b*.

The mixing component 608 then mixes the dialog enhanced signals 619 together with the channels 618*b* which were not involved in dialog enhancement $$\left(X_{DE} = C \cdot \begin{bmatrix} X_e \\ X_u'' \end{bmatrix}\right)$$

in order to produce dialog enhanced versions 620 of the subset 612*a* of downmix signals. The mixing component 608 makes the mixing in accordance with the current downmixing scheme, such as the downmixing scheme illustrated in FIG. 1*b*. In this case, the mixing parameters 622 thus correspond to a downmixing scheme describing into which downmix signal 620 each channel 619, 618*b* should be mixed. The downmixing scheme may be static and therefore known by the decoder 600, meaning that the same downmixing scheme always applies, or the downmixing scheme may be dynamic, meaning that it may vary from frame to frame, or it may be one of several schemes known in the decoder. In the latter case, an indication regarding the downmixing scheme is included in the data stream 610.

In FIG. 6, the decoder is equipped with an optional reshuffle component 630. The reshuffle component 630 may be used to convert between different downmixing schemes, e.g. to convert from the scheme 100*b* to the scheme 100*a*. It is noted that the reshuffle component 630 typically leaves the c and lfe signals unchanged, i.e., it acts as a pass-through component in respect of these signals. The reshuffle component 630 may receive and operate (not shown) based on various parameters such as for example the reconstruction parameters 614 and the parameters for dialog enhancement 616.

Figure 7:
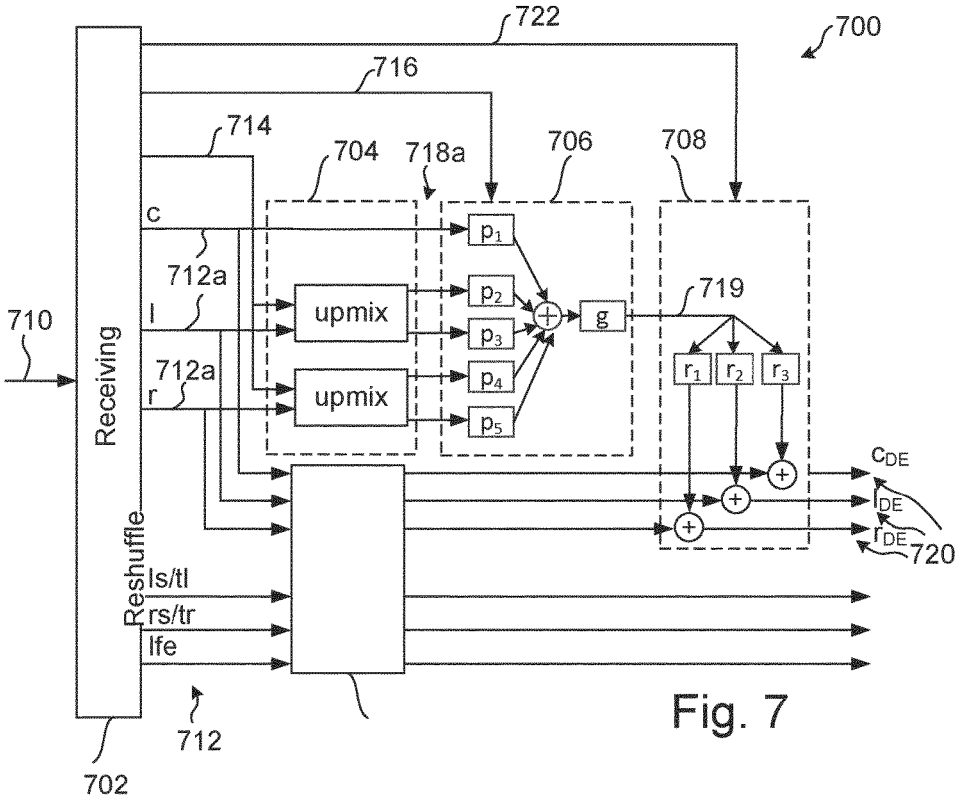
FIG. 7 is a schematic illustration of a decoder according to example embodiments.

FIG. 7 illustrates a decoder 700 which corresponds to an exemplary embodiment of the decoder 500 of FIG. 5. The decoder 700 comprises a receiving component 702, an upmixing component 704, a dialog enhancement component 706, and a mixing component 708.

Similar to the decoder 500 of FIG. 5, the receiving component 702 receives a data stream 710 and decodes it into a plurality of downmix signals 712, reconstruction parameters 714, and parameters for dialog enhancement 716.

The upmixing component 704 receives a subset 712*a* (corresponding to subset 512*a*) of the plurality of downmix signals 712. In contrast to the embodiment described with respect to FIG. 6, the upmixing component 704 only reconstructs the subset 718*a* of the plurality of channels with respect to which the parameters for dialog enhancement 716 are defined ($X'_u = U' \cdot X$). Referring to FIG. 1*b*, the channels 718*a* with respect to which the parameters for dialog enhancement are defined could for instance correspond to the C, L, LS, R, RS channels.

The dialog enhancement component 706 then performs dialog enhancement on the channels 718*a* with respect to which the parameters for dialog enhancement are defined ($X_d = M_d \cdot X'_u$). In this case, the dialog enhancement component 706 proceeds to predict a dialog component on basis of the channels 718*a* by forming a linear combination of the channels 718*a*, according to a second mode of dialog enhancement. The coefficients used when forming the linear combination, denoted by $p_1$ through $p_5$ in FIG. 7, are included in the parameters for dialog enhancement 716. The predicted dialog component is then enhanced by multiplication of a gain factor g to produce a dialog enhanced signal 719. The gain factor g may be expressed as:

$$g = 10^{\frac{G}{20}} - 1$$

where G is a dialog enhancement gain expressed in dB. The dialog enhancement gain G may for example be input by a user, and is therefore typically not included in the data stream 710. It is to be noted that in case there are several dialog components, the above predicting and enhancing procedure may be applied once per dialog component.

The predicted dialog enhanced signal 719 (i.e. the predicted and enhanced dialog components) is then mixed into the subset 712*a* of downmix signals in order to produce dialog enhanced versions 720 of the subset 712*a* of downmix signals $$\left(X_{DE} = C \cdot \begin{bmatrix} X_d \\ X \end{bmatrix}\right).$$

The mixing is made in accordance with mixing parameters 722 describing a contribution of the dialog enhanced signal 719 to the dialog enhanced versions 720 of the subset of downmix signals. The mixing parameters are typically included in the data stream 710. In this case, the mixing parameters 722 correspond to weighting factors $r_1$, $r_2$, $r_3$ describing how the at least one dialog enhanced signal 719 should be weighted into the subset 712*a* of downmix signals:

$$X_{DE} = X + \begin{bmatrix} r_1 \\ r_2 \\ r_3 \end{bmatrix} \cdot X_d = \begin{bmatrix} r_1 & 1 & 0 & 0 \\ r_2 & 0 & 1 & 0 \\ r_3 & 0 & 0 & 1 \end{bmatrix} \cdot \begin{bmatrix} X_d \\ X_1 \\ X_2 \\ X_3 \end{bmatrix}.$$

In more detail, the weighting factors may correspond to rendering coefficients that describe the panning of the at least one dialog enhanced signal 719 with respect to the subset 712*a* of downmix signals, such that the dialog enhanced signal 719 is added to the downmix signals 712*a* at the correct spatial positions.

The rendering coefficients (the mixing parameters 722) in the data stream 710 may correspond to the upmixed channels 718*a*. In the illustrated example, there are five upmixed channels 718*a* and there may thus be five corresponding rendering coefficients, rc1, rc2, . . . , rc5, say. The values of r1, r2, r3 (which corresponds to the downmix signals 712*a*) may then be calculated from rc1, rc2, . . . , rc5, in combination with the downmixing scheme. When multiple of the channels 718*a* correspond to the same downmix signal 712*a*, the dialog rendering coefficients can be summed. For example, in the illustrated example, it holds that r1=rc1, r2=rc2+rc3, and r3=rc4+rc5. This may also be a weighted summation in case the downmixing of the channels was made using downmixing coefficients.

It is to be noted that also in this case the dialog enhancement component 706 may make use of an additionally received audio signal representing dialog. In such a case the predicted dialog enhanced signal 719 may be weighted together with the audio signal representing dialog prior to being input to the mixing component 708 ($X_d=(1-\alpha_c)\cdot M_d\cdot X'_u+\alpha_c\cdot g\cdot D_c$). The appropriate weighting is given by a blending parameter $\alpha_c$ included in the parameters for dialog enhancement 716. The blending parameter $\alpha_c$ indicates how the gain contributions should be divided between the predicted dialog component 719 (as described above) and the additional audio signal representing dialog $D_c$. This is analogous to what was described with respect to the third dialog enhancement mode when combined with the second dialog enhancement mode.

In FIG. 7, the decoder is equipped with an optional reshuffle component 730. The reshuffle component 730 may be used to convert between different downmixing schemes, e.g. to convert from the scheme 100*b* to the scheme 100*a*. It is noted that the reshuffle component 730 typically leaves the c and lfe signals unchanged, i.e., it acts as a pass-through component in respect of these signals. The reshuffle component 730 may receive and operate (not shown) based on various parameters such as for example the reconstruction parameters 714 and the parameters for dialog enhancement 716.

The above has mainly been explained with respect to a 7.1+4 channel configuration and a 5.1 downmix. However, it is to be understood that the principles of the decoders and decoding methods described herein apply equally well to other channel and downmix configurations.

Figure 8:
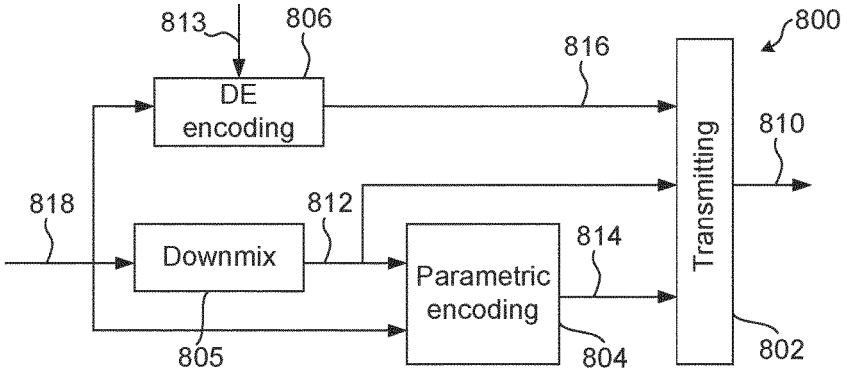
FIG. 8 is a schematic illustration of an encoder corresponding to any one of the decoders in FIG. 2, FIG. 5, FIG. 6, and FIG. 7.

FIG. 8 is an illustration of an encoder 800 which may be used to encode a plurality of channels 818, of which some include dialog, in order to produce a data stream 810 for transmittal to a decoder. The encoder 800 may be used with any of decoders 200, 500, 600, 700. The encoder 800 comprises a downmix component 805, a dialog enhancement encoding component 806, a parametric encoding component 804, and a transmitting component 802.

The encoder 800 receives a plurality of channels 818, e.g. those of the channel configurations 100*a*, 100*b* depicted in FIGS. 1*a* and 1*b*.

The downmixing component 805 downmixes the plurality of channels 818 into a plurality of downmix signals 812 which are then fed to the transmitting component 802 for inclusion in the data stream 810. The plurality of channels 818 may e.g. be downmixed in accordance with a downmixing scheme, such as that illustrated in FIG. 1*a* or in FIG. 1*b*.

The plurality of channels 818 and the downmix signals 812 are input to the parametric encoding component 804. On basis of its input signals, the parametric encoding component 804 calculates reconstruction parameters 814 which enable reconstruction of the channels 818 from the downmix signals 812. The reconstruction parameters 814 may e.g. be calculated using minimum mean square error (MMSE) optimization algorithms as is known in the art. The reconstruction parameters 814 are then fed to the transmitting component 802 for inclusion in the data stream 810.

The dialog enhancement encoding component 806 calculates parameters for dialog enhancement 816 on basis of one or more of the plurality of channels 818 and one or more dialog signals 813. The dialog signals 813 represents pure dialog. Notably, the dialog is already mixed into one or more of the channels 818. In the channels 818 there may thus be one or more dialog components which correspond to the dialog signals 813. Typically, the dialog enhancement encoding component 806 calculates parameters for dialog enhancement 816 using minimum mean square error (MMSE) optimization algorithms. Such algorithms may provide parameters which enable prediction of the dialog signals 813 from some of the plurality of channels 818. The parameters for dialog enhancement 816 may thus be defined with respect to a subset of the plurality of channels 818, viz. those from which the dialog signals 813 may be predicted. The parameters for dialog prediction 816 are fed to the transmitting component 802 for inclusion in the data stream 810.

In conclusion, the data stream 810 thus at least comprises the plurality of downmix signals 812, the reconstruction parameters 814, and the parameters for dialog enhancement 816.

During normal operation of the decoder, values of the parameters of different types (such as the parameters for dialog enhancement, or the reconstruction parameters) are received repeatedly by the decoder at certain rates. If the rates at which the different parameter values are received are lower than the rate at which the output from the decoder must be calculated, the values of the parameters may need to be interpolated. If the value of a generic parameter p is known, at the points $t_1$ and $t_2$ in time, to be $p(t_1)$ and $p(t_2)$ respectively, the value p(t) of the parameter at an intermediate time $t_1 \le t < t_2$ may be calculated using different interpolation schemes. One example of such a scheme, herein referred to as a linear interpolation pattern, may calculate the intermediate value using linear interpolation, e.g. $p(t)=p(t_1)+[p(t_2)-p(t_1)](t-t_1)/(t_2-t_1)$. Another pattern, herein referred to as a piecewise constant interpolation pattern, may instead include keeping a parameter value fixed at one of the known values during the whole time interval, e.g. $p(t)=p(t_1)$ or $p(t)=p(t_2)$, or a combination of the known values such as for example the mean value $p(t)=[p(t_1)+p(t_2)]/2$. Information about what interpolation scheme is to be used for a certain parameter type during a certain time interval may be built into the decoder, or provided to the decoder in different ways such as along with the parameters themselves or as additional information contained in the received signal.

In an illustrative example, a decoder receives parameter values for a first and a second parameter type. The received values of each parameter type are exactly applicable at a first ($T1=\{t11, t12, t13, \ldots\}$) and a second ($T2=\{t21, t22, t23, \ldots\}$) set of time instants, respectively, and the decoder also has access to information about how the values of each parameter type are to be interpolated in the case that a value needs to be estimated at a time instant not present in the corresponding set. The parameter values control quantitative properties of mathematical operations on the signals, which operations may for instance be represented as matrices. In the example that follows, it is assumed that the operation controlled by the first parameter type is represented by a first matrix A, the operation controlled by the second parameter type is represented by a second matrix B, and the terms "operation" and "matrix" may be used interchangeably in the example. At a time instant where an output value from the decoder needs to be calculated, a joint processing operation corresponding to the composition of both operations is to be computed. If it is further assumed that the matrix A is the operation of upmixing (controlled by the reconstruction parameters) and that the matrix B is the operation of applying dialog enhancement (controlled by the parameters for dialog enhancement) then, consequently, the joint processing operation of upmixing followed by dialog enhancement is represented by the matrix product BA.

Methods of computing the joint processing operation are illustrated in FIGS. 9*a*-9*e*, where time runs along the horizontal axis and axis tick-marks indicate time instants at which a joint processing operation is to be computed (output time instants). In the figures, triangles correspond to matrix A (representing the operation of upmixing), circles to matrix B (representing the operation of applying dialog enhancement) and squares to the joint operation matrix BA (representing the joint operation of upmixing followed by dialog enhancement). Filled triangles and circles indicate that the respective matrix is known exactly (i.e. that the parameters, controlling the operation which the matrix represents, are known exactly) at the corresponding time instant, while empty triangles and circles indicate that the value of the respective matrix is predicted or interpolated (using e.g. any of the interpolation patterns outlined above). A filled square indicates that the joint operation matrix BA has been computed, at the corresponding time instant, e.g. by a matrix product of matrices A and B, and an empty square indicates that the value of BA has been interpolated from an earlier time instant. Furthermore, dashed arrows indicate between which time instants an interpolation is performed. Finally, a solid horizontal line connecting time instants indicates that the value of a matrix is assumed to be piecewise constant on that interval.

Figure 9A:
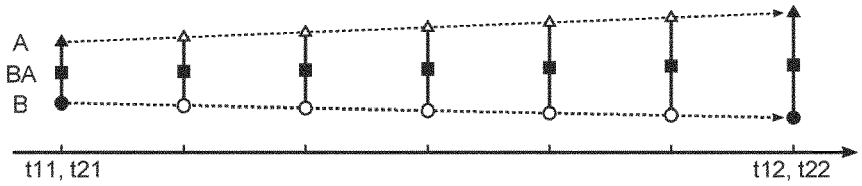
FIG. 9 illustrates methods for computing a joint processing operation BA composed of two sub-operations A and B, on the basis of parameters controlling each of the sub-operations.
Figure 9B:
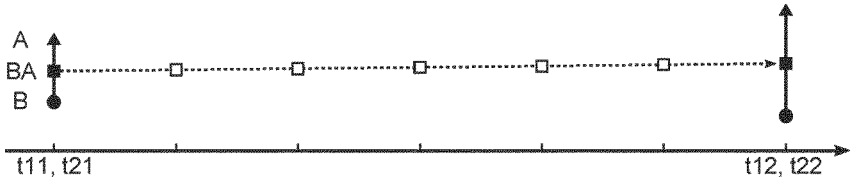
Figure 9C:
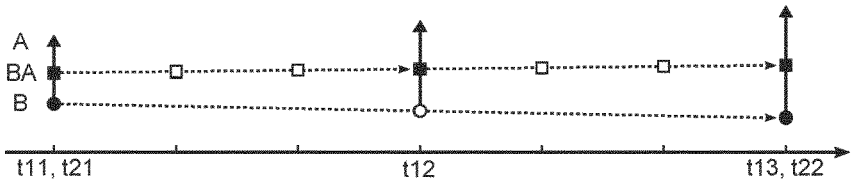
Figure 9D:
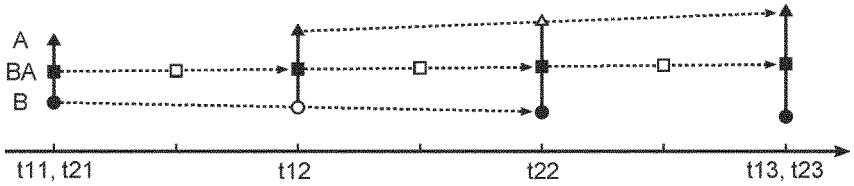
Figure 9E:
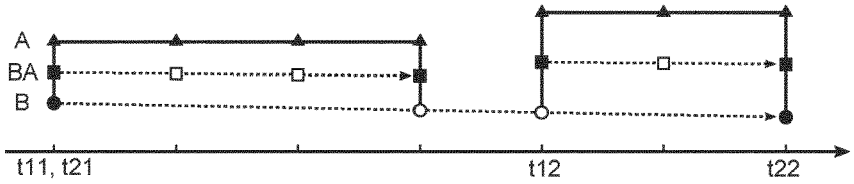

A method of computing a joint processing operation BA, not making use of the present invention, is illustrated in FIG. 9*a*. The received values for operations A and B applies exactly at time instants t11, t21 and t12, t22 respectively, and to compute the joint processing operation matrix at each output time instant the method interpolates each matrix individually. To complete each forward step in time, the matrix representing the joint processing operation is computed as a product of the predicted values of A and B. Here, it is assumed that each matrix is to be interpolated using a linear interpolation pattern. If the matrix A has N' rows and N columns, and the matrix B has M rows and N' columns, each forward step in time would require O(MN'N) multiplication operations per parameter band (in order to perform the matrix multiplication required to compute the joint processing matrix BA). A high density of output time instants, and/or a large number of parameter bands, therefore risks (due to the relatively high computational complexity of a multiplication operation compared with an addition operation) putting a high demand on the computational resources. To reduce the computational complexity, the alternative method illustrated in FIG. 9*b* may be used. By computing the joint processing operation (e.g. performing a matrix multiplication) only at the time instants where the parameter values change (i.e., where received values are exactly applicable, at t11, t21 and t12, t22), the joint processing operation matrix BA may be interpolated directly instead of interpolating the matrices A and B separately. By so doing, if the operations are represented by matrices, each step forward in time (between the time instants where the exact parameter values change) will then only require O(NM) operations (for matrix addition) per parameter band, and the reduced computational complexity will put less demand on the computational resources. Also, if the matrices A and B are such that $N'>N\times M/(N+M)$, the matrix representing the joint processing operation BA will have fewer elements than found in the individual matrices A and B combined. The method of interpolating the matrix BA directly will, however, require that both A and B are known at the same time instants. When the time instants for which A is defined are (at least partially) different from the time instants for which B is defined, an improved method of interpolation is required. Such an improved method, according to exemplary embodiments of the present invention, is illustrated in FIGS. 9*c*-9*e*. In connection with the discussion of FIGS. 9*a*-9*e*, it is assumed for simplicity that the joint processing operation matrix BA is computed as a product of the individual matrices A and B, each of which has been generated on the basis of (received or predicted/interpolated) parameter values. In other situations, it may be equally or more advantageous to compute the operation represented by the matrix BA directly from the parameter values, without passing via a representation as two matrix factors. In combination with any of the techniques illustrated with reference to FIGS. 9*c*-9*e*, each of these approaches falls within the scope of the present invention.

In FIG. 9*c*, a situation is illustrated where the set T1 of time instants for the parameter corresponding to matrix A includes a time value t12 not present in the set T2 (time instants for the parameter corresponding to matrix B). Both matrices are to be interpolated using a linear interpolation pattern, and the method identifies the prediction instant $t_p$=t12 where the value of matrix B must be predicted (using e.g. interpolation). After the value has been found, the value of the joint processing operation matrix BA at $t_p$ may be computed by multiplying A and B. To continue, the method computes the value of BA at an adjacent time instant $t_a$=t11, and then interpolates BA between $t_a$ and $t_p$. The method may also compute, if desired, the value of BA at another adjacent time instant $t_a$=t13, and interpolate BA from $t_p$ to $t_a$. Even though an additional matrix multiplication (at $t_p$=t12) is required, the method allows interpolating the joint processing operation matrix BA directly, still reducing computational complexity compared to the method in e.g. FIG. 9*a*. As stated above, the joint processing operation may alternatively be computed directly from the (received or predicted/interpolated) parameter values rather than as an explicit product of two matrices that in turn depend on the respective parameter values.

In the previous case, only the parameter type corresponding to A had time instants that were not included among the instants of the parameter type corresponding to B. In FIG. 9*d*, a different situation is illustrated where the time instant t12 is missing from set T2, and where the time instant t22 is missing from set T1. If a value of BA is to be computed at an intermediate time instant t' between t12 and t22, the method may predict both the value of B at $t_p$=t12 and the value of A at $t_a$=t22. After computing the joint processing operation matrix BA at both times, BA may be interpolated to find its value at t'. In general, the method only performs matrix multiplications at instants of time where parameter values change (that is, at the time instants in the sets T1 and T2 where the received values are applicable exactly). In between, interpolation of the joint processing operation only requires matrix additions having less computational complexity than their multiplication counterparts.

In the examples above, all interpolation patterns have been assumed to be linear. A method for interpolation also when the parameters are initially to be interpolated using different schemes is illustrated in FIG. 9*e*. In the figure, the values of the parameter corresponding to matrix A are kept to be piecewise constant up until time instant t12, where the values abruptly change. If the parameter values are received on a frame-wise basis, each frame may carry signalling indicating a time instant at which a received value applies exactly. In the example, the parameter corresponding to B only has received values applicable exactly at t21 and t22, and the method may first predict the value of B at the time instant $t_p$ immediately preceding t12. After computing the joint processing operation matrix BA at $t_p$, and $t_a$=t11, the matrix BA may be interpolated between $t_a$ and $t_p$. The method may then predict the value of B at a new prediction instant $t_p$=t12, compute the values of BA at $t_p$ and $t_a$=t22, and interpolate BA directly between $t_p$ and $t_a$. Once again, the joint processing operation BA has been interpolated across the interval, and its value has been found at all output time instants. Compared to the earlier situation, as illustrated in FIG. 9*a*, where A and B would have been individually interpolated, and BA computed by multiplying A and B at each output time instant, a reduced number of matrix multiplications is needed and the computational complexity is lowered.

EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A method for enhancing dialog in a decoder of an audio system, the method comprising the steps of:

receiving a plurality of downmix signals being a downmix of a larger plurality of channels;

receiving parameters for dialog enhancement, wherein the parameters are defined with respect to a subset of the plurality of channels including channels comprising dialog, wherein the subset of the plurality of channels is downmixed into a subset of the plurality of downmix signals, wherein the subset of the plurality of downmix signals contains fewer downmix signals than the plurality of downmix signals;

receiving reconstruction parameters allowing parametric reconstruction of channels that are downmixed into the subset of the plurality of downmix signals;

upmixing only the subset of the plurality of downmix signals parametrically based on the reconstruction parameters in order to reconstruct only a subset of the plurality of channels including the subset of the plurality of channels with respect to which the parameters for dialog enhancement are defined;

applying dialog enhancement to the subset of the plurality of channels with respect to which the parameters for dialog enhancement are defined using the parameters for dialog enhancement so as to provide at least one dialog enhanced signal; and providing dialog enhanced versions of the subset of the plurality of downmix signals by mixing the at least one dialog enhanced signal with at least one other signal.

2. The method of claim 1, wherein, in the step of upmixing only the subset of the plurality of downmix signals parametrically, no decorrelated signals are used in order to reconstruct only a subset of the plurality of channels including the subset of the plurality of channels with respect to which the parameters for dialog enhancement are defined.

3. The method of claim 1, wherein the mixing is made in accordance with mixing parameters describing a contribution of the at least one dialog enhanced signal to the dialog enhanced versions of the subset of the plurality of downmix signals.

4. The method of claim 1, wherein the step of upmixing only the subset of the plurality of downmix signals parametrically comprises reconstructing only the subset of the plurality of channels with respect to which the parameters for dialog enhancement are defined, wherein the step of applying dialog enhancement comprises predicting and enhancing a dialog component from the subset of the plurality of channels with respect to which the parameters for dialog enhancement are defined using the parameters for dialog enhancement so as to provide the at least one dialog enhanced signal, and wherein the mixing comprises mixing the at least one dialog enhanced signal with the subset of the plurality of downmix signals.

5. The method of claim 1, further comprising: receiving an audio signal representing dialog, wherein the step of applying dialog enhancement comprises applying dialog enhancement to the subset of the plurality of channels with respect to which the parameters for dialog enhancement are defined further using the audio signal representing dialog.

6. The method of claim 1, further comprising receiving mixing parameters for mixing the at least one dialog enhanced signal with at least one other signal.

7. The method of claim 1, wherein the steps of upmixing only the subset of the plurality of downmix signals, applying dialog enhancement, and mixing are performed as matrix operations defined by the reconstruction parameters, the parameters for dialog enhancement, and the mixing parameters, respectively, and optionally, further comprising combining, by matrix multiplication, the matrix operations corresponding to the steps of upmixing only the subset of the plurality of downmix signals, applying dialog enhancement, and mixing, into a single matrix operation before application to the subset of the plurality of downmix signals.

8. The method of claim 1, wherein the dialog enhancement parameters and the reconstruction parameters are frequency dependent.

9. The method of claim 8, wherein the parameters for dialog enhancement are defined with respect to a first set of frequency bands and the reconstruction parameters are defined with respect to a second set of frequency bands, the second set of frequency bands being different than the first set of frequency bands.

10. The method of claim 1, wherein:

values of the parameters for dialog enhancement are received repeatedly and are associated with a first set of time instants (T1={t11, t12, t13, . . . }), at which respective values apply exactly, wherein a predefined first interpolation pattern (I1) is to be performed between consecutive time instants; and values of the reconstruction parameters are received repeatedly and are associated with a second set of time instants (T2={t21, t22, t23, . . . }), at which respective values apply exactly, wherein a predefined second interpolation pattern (I2) is to be performed between consecutive time instants, the method further comprising:

selecting a parameter type being either parameters for dialog enhancement or reconstruction parameters and in such manner that the set of time instants associated with the selected type comprises at least one prediction instant being a time instant ($t_p$) that is absent from the set associated with the not-selected type;

predicting a value of the parameters of the not-selected type at the prediction instant ($t_p$);

computing, based on at least the predicted value of the parameters of the not-selected type and a received value of the parameters of the selected type, a joint processing operation representing at least upmixing of only the subset of the downmix signals followed by dialog enhancement at the prediction instant ($t_p$); and computing, based on at least a value of the parameters of the selected type and a value of the parameters of the not-selected type, at least either being a received value, said joint processing operation at an adjacent time instant ($t_a$) in the set associated with the selected or the not-selected type, wherein said steps of upmixing only the subset of the plurality of downmix signals and applying dialog enhancement are performed between the prediction instant ($t_p$) and the adjacent time instant ($t_a$) by way of an interpolated value of the computed joint processing operation.

11. The method of claim 10, wherein the selected type of parameters is the reconstruction parameters.

12. The method of claim 10, wherein said joint processing operation at the adjacent time instant ($t_a$) is computed based on a received value of the parameters of the selected type and a received value of the parameters of the not-selected type.

13. The method of claim 10, further comprising selecting, on the basis of the first and second interpolation patterns, a joint interpolation pattern (I3) according to a predefined selection rule, wherein said interpolation of the computed respective joint processing operations is in accordance with the joint interpolation pattern.

14. The method of claim 13, wherein the predefined selection rule is defined for the case where the first and second interpolation patterns are different.

15. The method of claim 14, wherein, in response to the first interpolation pattern (I1) being linear and the second interpolation pattern (I2) being piecewise constant, linear interpolation is selected as the joint interpolation pattern.

16. The method of claim 10, wherein the prediction of the value of the parameters of the not-selected type at the prediction instant ($t_p$) is made in accordance with the interpolation pattern for the parameters of the not-selected type.

17. The method of claim 10, wherein the joint processing operation is computed as a single matrix operation before it is applied to the subset of the plurality of downmix signals, and optionally, wherein:

linear interpolation is selected as the joint interpolation pattern; and the interpolated value of the computed respective joint processing operations is computed by linear matrix interpolation.

18. The method of claim 1, wherein the mixing of the at least one dialog enhanced signal with at least one other signal is restricted to a non-complete selection of the plurality of downmix signals.

19. A non-transitory computer-readable storage medium comprising a sequence of instructions, which, when performed by one or more processing devices, cause the one or more processing devices to perform the method of claim 1.

20. A decoder for enhancing dialog in an audio system, wherein the decoder:

receives a plurality of downmix signals being a downmix of a larger plurality of channels;

receives parameters for dialog enhancement, wherein the parameters are defined with respect to a subset of the plurality of channels including channels comprising dialog, wherein the subset of the plurality of channels is downmixed into a subset of the plurality of downmix signals, wherein the subset of the plurality of downmix signals contains fewer downmix signals than the plurality of downmix signals;

receives reconstruction parameters allowing parametric reconstruction of channels that are downmixed into the subset of the plurality of downmix signals;

upmixes only the subset of the plurality of downmix signals parametrically based on the reconstruction parameters in order to reconstruct only a subset of the plurality of channels including the subset of the plurality of channels with respect to which the parameters for dialog enhancement are defined; and applies dialog enhancement to the subset of the plurality of channels with respect to which the parameters for dialog enhancement are defined using the parameters for dialog enhancement so as to provide at least one dialog enhanced signal; and provides dialog enhanced versions of the subset of the plurality of downmix signals by mixing the at least one dialog enhanced signal with at least one other signal.

* * * * *